United States Patent [19]

Jenq

[11] Patent Number: 5,022,576

[45] Date of Patent: Jun. 11, 1991

[54] LEVER-OPERATED PROTECTIVE COVER FOR A SAW TOOTH-SHAPED CUTTER

[76] Inventor: Jin-Huoo Jenq, No. 16, Lane 399, Section 3, Jong-Shan Road, Tan-Tzu Taichung, Taiwan

[21] Appl. No.: 297,083

[22] Filed: Jan. 13, 1989

[51] Int. Cl.[5] ..... B26F 3/02; B65H 35/07

[52] U.S. Cl. ..... 225/20; 225/91

[58] Field of Search ..... 225/19, 20, 91

[56] References Cited

U.S. PATENT DOCUMENTS

| | | | |
|---|---|---|---|
| 1,968,488 | 7/1934 | Hinsch | 225/20 |
| 2,470,250 | 5/1949 | Kienle | 225/20 |
| 2,777,594 | 1/1957 | Krueger | 225/20 |
| 3,731,863 | 5/1973 | Nausedas | 225/20 |

*Primary Examiner*—Hien H. Phan

*Attorney, Agent, or Firm*—Bucknam and Archer

[57] ABSTRACT

A protective cover plate is adapted to cooperate with a tape dispenser, and includes a lever having a blade-protecting cover as a handle and a pivotable base. The base is adapted to be normally in contact with an elastic guide plate of the dispenser. A part of the cross-section of the base has a V-shaped configuration, including a round apex, and faces away from the handle. The legs of the V-shaped configuration subtend a predetermined angle with one another, and converge at the round apex. Two pins extend on respective opposite sides of the base into holes formed in respective frame plates of the dispenser, rendering the protective cover pivotably disposed on the tape dispenser. The lever occupies a first stable non-operative position, when the handle covers the cutter. By pivoting the lever with sufficient force away from the cutter, so as to overcome a pressure exerted by the elastic guide plate of the tape dispenser, the protective cover assumes a second stable and operative position.

2 Claims, 2 Drawing Sheets

LEVER-OPERATED PROTECTIVE COVER FOR A SAW TOOTH-SHAPED CUTTER

The present invention relates to a protective cover for use with a sawtoothed-shaped cutter of a dispenser.

BACKGROUND OF THE INVENTION

Tapes are essential articles which are required for general industry and business operations, and are widely used in various industries and fields. As the blade of a saw-tooth cutter of most present tape dispensers is directly exposed outside of the dispenser and appears with sharp teeth, it therefore can easily cause a user to get hurt, when careless; alternately its blade might change shape, or be damaged due to shock, and thus be in a poor condition for a user.

OBJECTS OF THE INVENTION

While it is believed essential to install a protecting cover over the blade, it is believed that the protecting cover should meet the following characteristics, so as to be useful in practice. It should be suitable for mass production, easy to assemble, inexpensive to produce, primarily because it is a disposable product for most people, who will throw it away after use, and in any case, it is used only for a short time.

Therefore, based on the understanding that it will not increase the consumer's burden and is expected to achieve a wide popularity, it should nevertheless meet the objects of the invention, i.e. not to allow a user to get hurt and/or not to let the product be damaged.

The protective cover of this invention can stay on the blade, while it is protecting the same, but should be remote from the tape used, as long as it is not in a position where a user can come in contact during the cutting of the tape. It thus should meet the objects desired for application to a tape dispenser.

SUMMARY OF THE INVENTION

These objects are achieved by a protective cover plate adapted to cooperate with a tape dispenser which has two frame plates, a roller rotatably disposed between the frame plates, a cutter positioned downstream of the roller, and an elastic guide plate extending in a direction downstream from the cutter, and wherein a portion of the tape to be dispensed normally passes over the roller and beyond the guide plate.

The protective cover basically includes a lever having a blade-protecting cover as a handle and including a pivotable base.

A part of the cross-sectional portion of the base has a two-legged V-shaped configuration, includes a round apex, and faces away from the handle.

The legs of the V-shaped portion subtend a predetermined angle with one another, and converge into the round apex.

Two pins substantially coaxial with the axis of the base, extend on respective opposite sides of the base, so that, when the pins of the protective cover are inserted into holes formed in respective of two frame plates of the tape dispenser, the protective cover will be pivotably disposed on the tape dispenser around the pivoting axis. The protective cover may therefore be made to occupy a first stable non-operative position when positioned to at least partially cover the cutter, so as to protect a user from the cutter.

It may only be dislodged from its non-operative position to a second stable, and operative position by pivoting the protective cover with sufficient force in a direction away from the cutter, so as to overcome the pressure exerted by the elastic guide plate on the round apex of the V-shaped base.

In an advantageous version the blade-protecting cover includes an approximately J-shaped portion, and the lever is constituted by the aforedescribed J-shaped portion, and a substantially rectangular section adjoining the J-shaped portion. The latter defines a substantially rectangular contour in cross-section, and the base terminates an end of the substantially rectangular section opposite the J-shaped portion. It is further beneficial if the J-shaped portion, as seen in cross-section, subtends an arc of about ninety degrees.

DESCRIPTION OF THE DRAWINGS

The present invention will be better understood with the aid of the drawings, in which.

DESCRIPTION OF THE PREFERRED EMBODIMENT

Figure 1:
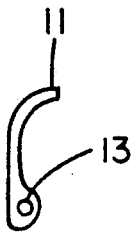
FIG. 1 is a top plan view of the inventive protective cover.
Figure 2:
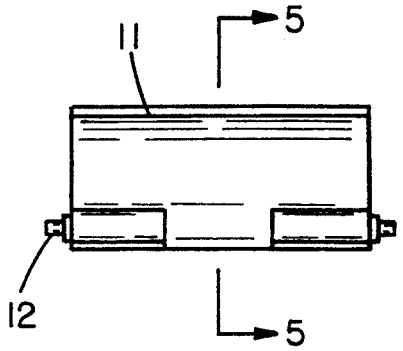
FIG. 2 is a right side view of the inventive protective cover.
Figure 3:
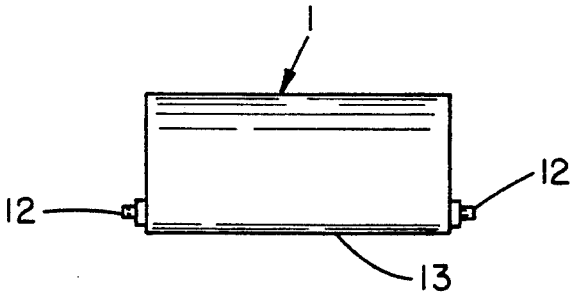
FIG. 3 is a left side view of the inventive protective cover.

The present invention primarily relates to a novel lever-operated protective cover 1, which is installed in front of a cutter 2 of a tape dispenser. The protective cover is pivotably installed between a pair of frame plates 3 by a pair of screws 12, and can be pivoted about its axis; the protective cover 1 is also located above a plastic elastic plate 4.

By means of the specific inventive bottom structure, the protective cover 1, in conjunction with an elastic plate 4, permits the protective cover 1 to assume two stable specific positions, i.e. a "protective position", and a "position for use".

Figure 5:
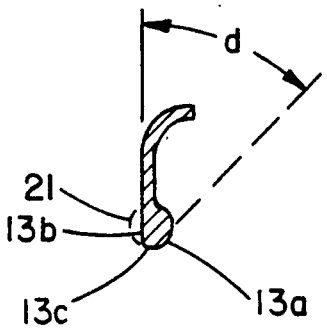
FIG. 5 is a sectional view along line 2—2 of FIG. 2 of the inventive protective cover.
Figure 4:
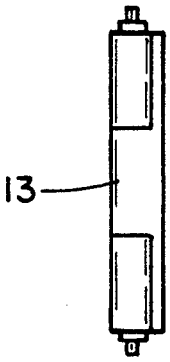
FIG. 4 is a bottom plan view of the inventive protective cover.
Figure 6:
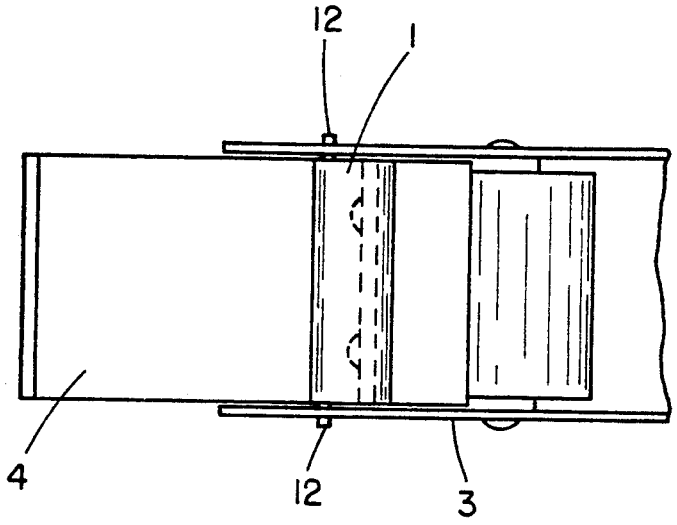
FIG. 6 is a to plan view, showing the installed protective cover in a position when protecting a cutter of the tape dispenser.

As shown in FIGS. 1–5, the structure of the protective cover includes a lever in the form of a J-shaped plate 11, and its curved portion which is at an angle, can be used as a handle. It also includes a pair of screws 12, and a base 13 located near one end of the plate 11. The J-shaped plate 11 is roughly as wide as the cutter 2, but is slightly narrower than the distance between the pair of frame plates 3, as seen in FIG. 6.

When the plate 11 is shielding or covering the cutter 2, it still remains at a certain distance from the cutter 2 to prevent the plate 11 from damaging the cutter 2 due to, e.g. shock.

Screws 12 are located at each side of the base 13, and each one has a cylindrical pin extending outwardly therefrom, which is allowed to be passed into a respective aligned hole in the frame plate 3.

Figure 7:
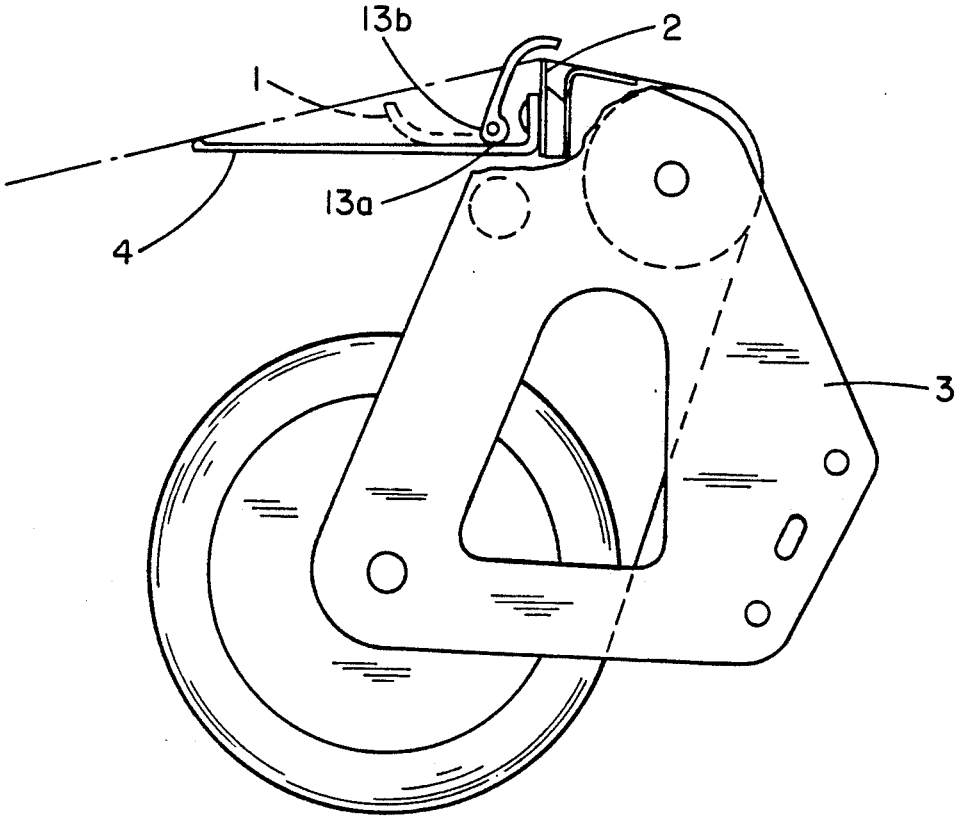
FIG. 7 is a side view, showing the tape dispenser, where the protective cover is shown by a dotted line when in use, but by a solid line, when it is protecting the cutter of the tape dispenser.

The base which is a major feature of the present invention employs a central axis formed by the pins between which the base 13 is located. The cross-sectioned portion of the base as seen in FIG. 5, has a V-shaped configuration, formed by straight lines 13*a* and 13*b* converging at a rounded apex 13*c* at their connection position. The apex 13*c* is normally located above the plastic elastic plate 4 and the lines 13*a* and 13*b* appear in a stable state, that is as shown in FIG. 7 in solid lines, that is in the protecting non-operative position in which the protective cover extends in front of the cutter. A similar stable state would be achieved, if one were to imagine the line 13*b* to face the elastic plate 4. However, if the apex 13*c* is pressed forcibly against the elastic plate 4, the elastic plate 4 thus is pressed downwards, because it maintains an upwardly directed elasticity. As the apex 13*c* appears as a round arc, when the base 13 is pivoted, the apex 13*c* makes contact with the plate 4, so that it then appears in an unsteady or "unstable" state. The structure of the base 13, which, as seen in cross section, is formed with the two straight non-contiguous lines 13*a* and 13*b*, thus permits the protective cover 1 to assume two stable positions, and one intermediate unstable position, corresponding to lines 13*a* and 13*b*, on one hand, and arc 13*c*, on the other hand, respectively, making contact with the plate 4. The operative position in which the cutter is cutting the tape is shown in dotted lines in FIG. 7.

FIGS. 6 and 7 show the protective cover 1 of the present invention installed on a tape dispenser. In FIG. 6, the protective cover 1 is located in a "protective position", i.e. the J-shaped portion of the protective cover 1 is located above the cutter 2, and its base 13 presses upon the elastic plate 4.

Due to the arc 13*c*, the base 13 permits the protective cover 1 to be pulled backwards only by force, and enables the arc 13*c* to exert pressure onto the elastic plate 4 first, and only thereafter allowing it to move away from the "protective position", so as to then assume a "Use position", such as shown by dotted lines in FIG. 7. The protecting cover 1 in the latter position does not influence the operation of the tape being sliced by the cutter 2.

Based on what has been mentioned heretofore, the protective cover of the present invention utilizes both the features of the original elastic plate 4 and that of the specially shaped base 13 in the form of a V-shaped configuration formed by an arcuate apex 13 to enable the present invention to perform a useful function, and to be constructed so as to be easily capable of being mass-produced.

The scope of the invention shall be covered by the claims set forth hereinafter.

I claim:

1. A protective cover plate (1) adapted to cooperate with a tape dispenser having two frame plates (3) set at a predetermined distance, a roller rotatably disposed between said frame plates, a cutter (2) positioned downstream of said roller, and an elastic guide plate (4) extending in a direction downstream from said cutter, a portion of the tape to be dispensed normally passing over said roller and beyond said guide plate, said cover plate comprising in combination a lever having a curved plate (11) serving as a handle and including a pivotable base (13) normally in contact with said elastic guide plate (4) of the tape dispenser, said curved plate being as wide as said cutter but narrower than the distance between said frame plates, a part of said base having in cross section a V-shaped configuration formed by two legs converging into a round apex facing away from said handle, said legs of said V-shaped part subtending a predetermined angle of about 90 degrees, two pins substantially extending on respective opposite sides of said base, each of said frame plates having an orifice, each of said pins being adapted to pass through each of said orifices, whereby, when said pins of said protective cover are inserted into said holes, they form a pivoting axis, said protective cover is pivotably disposed on said tape dispenser around said pivoting axis and said protective occupies a first stable non-operative position at a predetermined distance from said cutter, so as to protect a user from said cutter, and by pivoting said protective cover with sufficient force in a direction away from said cutter whereby pressure is applied on said protective cover, so as to overcome the pressure exerted by the elastic guide plate onto said apex of said V-shaped base portion, said protective cover is dislodged to a second operative position to permit cutting of the tape.

2. A protective cover according to claim 1, wherein said blade-protecting cover includes an approximately J-shaped portion, said lever being constituted by said approximately J-shaped portion, and a substantially rectangular section adjoining said J-shaped portion, the latter defining a substantially rectangular contour in cross-section, and wherein said base terminated an end of said substantially rectangular section opposite said J-shaped portion.

* * * * *